US006854951B2

(12) United States Patent
Mimuro

(10) Patent No.: US 6,854,951 B2
(45) Date of Patent: Feb. 15, 2005

(54) VERTICAL LIFT TYPE ARM DEVICE

(75) Inventor: Junji Mimuro, Sayama (JP)

(73) Assignees: Komatsu Ltd., Tokyo (JP); Komatsu Zenoah Co., Saitama (JP)

( * ) Notice: Subject to any disclaimer, the term of this patent is extended or adjusted under 35 U.S.C. 154(b) by 14 days.

(21) Appl. No.: 10/363,228

(22) PCT Filed: Aug. 30, 2001

(86) PCT No.: PCT/JP01/07480

§ 371 (c)(1),
(2), (4) Date: Mar. 5, 2003

(87) PCT Pub. No.: WO02/27107

PCT Pub. Date: Apr. 4, 2002

(65) Prior Publication Data

US 2004/0028514 A1 Feb. 12, 2004

(30) Foreign Application Priority Data

Sep. 26, 2000 (JP) ..... 2000-292948

(51) Int. Cl.[7] ..... B66C 23/00
(52) U.S. Cl. ..... 414/686; 414/685; 414/917
(58) Field of Search ..... 414/680, 685, 414/686, 917

(56) References Cited

U.S. PATENT DOCUMENTS 5,542,814 A * 8/1996 Ashcroft et al. ..... 414/686 X
5,609,464 A 3/1997 Moffitt et al.
6,132,163 A * 10/2000 Andrews et al. ..... 414/685

FOREIGN PATENT DOCUMENTS

| | | |
|---|---|---|
| GB | 2333759 A | 8/1999 |
| JP | 6-26068 | 2/1994 |
| JP | 6-136786 A | 5/1994 |

* cited by examiner

*Primary Examiner*—Donald W. Underwood
(74) *Attorney, Agent, or Firm*—Frishauf, Holtz, Goodman & Chick, P.C.

(57) ABSTRACT

A vertical lift type arm device includes a set of left and right control links each having three connection shaft holes, a set of left and right central mounting parts which are provided at a center part of the main frame, and a set of left and right mounting parts which are provided at rear parts of the lift arms and extend downward. Front end parts of the control links and the central mounting parts are pivotably attached to each other, center parts of the control links and lower end parts of the mounting parts are pivotably attached to each other, and connection axes of the control links and the central mounting parts are provided at a same height as or at a higher position than connection axes of lower end parts of the rear links and the main frame.

13 Claims, 15 Drawing Sheets

VERTICAL LIFT TYPE ARM DEVICE

TECHNICAL FIELD

The present invention relates to a vertical lift type arm device.

BACKGROUND ART

As a working vehicle shown in a side view in FIG. 15, a so-called skid-steer loader 100 is conventionally used. In such a skid-steer loader 100, a bucket 112, which can rise substantially vertically, is used to excavate, for example, earth, sand and the like, scoop them with the bucket 112 and load the earth and sand onto a truck not shown.

As the skid-steer loader 100 in which the bucket 112 can rise substantially vertical, the one that is disclosed in, for example, Japanese Patent Laid-open No. 6-26068 shown in FIG. 15 is cited. The right side is a front of a vehicle body in FIG. 15. The skid-steer loader 100 has a main frame 120 which extends longitudinally, has a link device 110 at the main frame 120, has an engine 122 at the rear part of the main frame 120, and has a driver's cab 130 on a top surface of the main frame 120. The main frame 120 has front wheels 141 at a lower front part thereof and rear wheels 142 at lower rear part thereof. A bucket 112 which is freely raised and lowered by a bucket cylinder 113 is rotatably provided at front end parts of a set of left and right lift arms 111 of the link device 110.

The link device 110 has the set of left and right lift arms 111, a set of left and right rear links 116, and a set of left and right rods 114. Rear end parts of the lift arms 111 are pivotably attached to upper end parts of the rear links 116, respectively. Lower end parts of the rear links 116 are pivotably attached at upper parts of a set of left and right upright members 121 that are provided at the rear part of the main frame 120. Mounting parts 111*a* each in a substantially inverted triangle shape are provided at central rear parts in a longitudinal direction of the lift arms 111 each with a bottom side part being fixed thereto. A vertex part of each of the mounting parts 111*a* extending downward is pivotably attached to each rear end part of the rod 114, and front end parts of the rods 114 are pivotably attached to an upper front part of the main frame 120. Rod upper end parts that are upper end parts of a set of left and right lift cylinders 115 are pivotably attached at rear parts of the bottom side parts of the mounting parts 111*a*. Cylinder lower end parts that are lower end parts of the lift cylinders 115 are pivotably attached in the vicinity of the engine 122 at the rear part of the main frame 120. Extension and contraction of the lift cylinders 115 make it possible to raise and lower tip ends of the lift arms 111 of the link device 110.

With the link device 110 of the skid steer loader 100 as described above, the front end parts of the lift arms 111 and the bucket 112 rise in such a manner as they move forward from the vehicle body following substantially an arc in the first half movement and they rise substantially vertically in the latter half of the movement when they rise as shown in FIG. 16.

As a skid-steer loader a bucket of which is made capable of rising substantially vertically of another prior art, there is the one disclosed in the U.S. Pat. No. 5,609,464 shown in FIG. 17. The right side is a front of a vehicle body in FIG. 17. A skid-steer loader 200 has a main frame 220 which extends longitudinally, has a link device 210 at the main frame 220, has an engine 222 at the rear part of the main frame 220, and has a driver's cab 230 on a top surface of the main frame 220. The main frame 220 has front wheels 241 at a lower front part thereof and rear wheels 242 at a lower rear part thereof. A bucket 212 which is freely raised and lowered by a bucket cylinder 213 is rotatably provided at front end parts of a set of left and right lift arms 211 of the link device 210.

The link device 210 has the set of left and right lift arms 211, a set of left and right rear links 216, and a set of left and right control links 214. Rear parts of the set of the lift arms 211 each has an end shape branched up and down, and each upper end part of the branched end is pivotably attached to an upper end part of each of the rear links 216. Lower end parts of the rear links 216 are pivotably attached at upper parts of upright members 221 that are provided at the rear part of the main frame 220. Lower end parts of the branched ends of the lift arms 211 are pivotably attached to the upper end parts of the control links 214, respectively. The lower end parts of the control links 214 are each pivotably attached in the vicinity of an engine 222 at a lower rear part of the main frame 220. Rod front end parts that are front end parts of a set of left and right lift cylinders 215 are each pivotably attached at central front parts in a longitudinal direction of the lift arms 211. Cylinder rear end parts that are rear end parts of the lift cylinders 215 are each pivotably attached in the vicinity of the engine 222 coaxially with the lower end parts of the control links 214, at the rear part of the main frame 220. Extension and contraction of the lift cylinders 215 make it possible to raise and lower tip ends of the lift arms 211 of the link device 210.

With the link device 210 of the skid-steer loader 200 as described above, the tip end parts of the lift arms 211 and the bucket 212 rise in such a manner as they move forward from the vehicle body following substantially an arc in the first half movement and they rise substantially vertically in the latter half of the movement, when they rise as shown in FIG. 18.

However, in the one shown in the aforementioned Japanese Patent Laid-open No. 6-26068, a lifting force of the front end parts of the lift arms 111 when the lift cylinders 115 are extended becomes as shown by the broken line in FIG. 19, and fluctuation of the lifting force is large. Accordingly, it becomes difficult to perform an excavating operation and a lifting operation with the bucket 112 which is provided at the front end parts of the lift arms 111. Since the rods 114 are located beside the driver's cab 130 when the lift arms 111 are raised as shown in FIG. 16, they obstruct an operator's view in a lateral direction, and the view in the lateral direction of the driver's cab is impaired. In a state in which the lift arms 111 are lowered as shown in FIG. 15, the lift cylinders 115 and the mounting parts 111*a* of the lift arms 111 are located beside the engine 122, which becomes an obstacle in performing maintenance of side faces of the engine 122, and a problem arises in maintainability.

In the one disclosed in the aforementioned U.S. Pat. No. 5,609,464 which is the other prior art, the rod parts of the front end parts of the lift cylinders 215 are each pivotably attached at the central front parts in the longitudinal direction of the lift arms 211, and therefore the lift cylinders 215 with a long stroke as shown in FIG. 18 are necessary. As shown in FIG. 18, when the lift arms 211 are raised, the lift cylinders 215 are located beside a driver's cab 230, which obstructs the operator's view in the lateral direction, and the lift cylinders 215 come in the view in the lateral direction, thus arising a problem in visibility. Further, in a state in which the lift arms 211 are lowered as shown in FIG. 17, the control links 214 and the lift cylinders 215 are located beside the engine 222, which becomes an obstacle in performing maintenance of the side faces of the engine 222, thus casing a problem in maintainability.

DISCLOSURE OF THE INVENTION

The present invention is made in view of the above-described problems, and has its object to provide a vertical lift type arm device with excellent maintainability of side faces of an engine, excellent visibility in a lateral direction from a driver's cab, and less fluctuation of a lifting force of front end parts of the lift arms.

In order to attain the above-described object, a first aspect of the vertical lift type arm device according to the present invention is a vertical lift type arm device in which rear end parts of a set of left and right lift arms are pivotably attached to a set of left and right upright members, which are vertically provided at a rear part of a main frame of a working vehicle, via a set of left and right rear links, and has a constitution including a set of left and right control links each having three connection shaft holes, a set of left and right central mounting parts which are provided at a center part of the main frame, and a set of left and right mounting parts which are provided at rear parts of the lift arms and extend downward, in which front end parts of the control links and the central mounting parts are pivotably attached to each other, center parts of the control links and lower end parts of the mounting parts are pivotably attached to each other, and connection axes of the control links and the central mounting parts are provided at a same height as or at a higher position than connection axes of lower end parts of the rear links and the main frame.

According to the above first constitution, when the lift arm is lowered, the control links are located at a higher position than the engine so as not to block the side faces of the engine, and therefore maintenance of the side faces of the engine is facilitated.

A second aspect of the vertical lift type arm device according to the present invention is a vertical lift type arm device in which rear end parts of a set of left and right lift arms are pivotably attached to a set of left and right upright members, which are vertically provided at a rear part of a main frame of a working vehicle, via a set of left and right rear links, and has a constitution including a set of left and right control links each having three connection shaft holes, a set of left and right central mounting parts which are provided at a center part of the main frame, a set of left and right mounting parts which are provided at rear parts of the lift arms and extend downward, and a set of left and right lift cylinders which raise and lower the lift arms, in which front end parts of the control links and the central mounting parts are pivotably attached to each other, center parts of the control links and lower end parts of the mounting parts are pivotably attached to each other, connection axes of the control links and the central mounting parts are provided at a same height as or at a higher position than connection axes of lower end parts of the rear links and the main frame, rear end parts of the control links are pivotably attached to upper end parts of the lift cylinders, and lower end parts of the lift cylinders are pivotably attached to lower rear parts of the main frame.

According to the above second constitution, the control links are not on the side faces of the engine room, and therefore maintenance of the side faces of the engine room is facilitated. Further, when the lift arms are raised and lowered, the mounting parts of the lift arms, the control links, and the lift cylinders on the side faces of the driver's cab do not obstruct the operator's view from the lateral side faces of the driver's cab, and therefore visibility in the lateral direction from the driver's cab is favorable. Further, when the lift arms are raised, fluctuations in the lifting force of the tip end parts of the lift arms are small.

Further, in the vertical lift type arm device, a constitution, in which undersurfaces of rear parts of the lift arms are curved upward, may be adopted.

According to the above constitution, the link device having the left and right lift arms, the control links and the rear links can be placed within predetermined widths on the left and the right seen from the top face, and therefore the left and the right constitutions of the link device can be each placed in substantially one plane. Accordingly, the link device lies off the vehicle body in the lateral direction by only a small amount, and the link device is not twisted.

Further, in the vertical lift type arm device, a constitution, in which undersurfaces of front parts of the control links are curved upward, may be adopted.

According to the above constitution, when the lift arms are lowered, if the engine room cover is rotated upward and opened, a space where hands are put into from the engine side faces is secured by the curved parts, and therefore maintenance of the side faces of the engine is facilitated.

Further, in the vertical lift type arm device, a constitution, in which the central mounting parts are provided by being off-set outside both left and right side faces of the main frame, may be adopted.

According to the above constitution, the link device having the left and right lift arms, control links and rear links can be placed within predetermined widths on the left and the right seen from the top face, the left and right constitutions of the link device can be each placed on one plane. Accordingly, the link device lies off the vehicle body in the lateral direction by only a small amount, and the link device is not twisted.

Further, in the vertical lift type arm device, a constitution including a rear cross member which fixes the set of left and right lift arms may be adopted.

According to the above constitution, the left and right lift arms are fixed by the rear cross member, which provides the lift arms with high twisting rigidity, and the lift arms are difficult to deform even in the case of an operation of scooping earth and sand.

Further, in the vertical lift type arm device, a constitution including a cross member which fixes the set of left and right rear links may be adopted.

According to the above constitution, the left and right rear links are fixed by the cross member, and the link device is given high rigidity, and is difficult to twist.

Further, in the vertical lift type arm device, a constitution, which includes a set of left and right masts, which are attached between the center part of the main frame and the set of left and right central mounting parts, with upper parts thereof supporting the central mounting parts, and with lower parts thereof extending downward to the rear and being attached to outer surfaces of both left and right side faces of the main frame, may be adopted.

According to the above constitution, the notched parts at the lower rear part of the driver's cab to avoid the masts are not needed, and therefore the shape of the driver's cab can be simplified.

Further, in the vertical lift type arm device, a constitution, in which the central mounting parts have lower parts thereof each in a shape extending downward to the rear, and which includes a set of left and right masts, which are attached between the center part of the main frame and the set of left and right central mounting parts extending downward to the rear, with upper parts thereof supporting the central mounting parts, and with lower parts thereof being attached to outer surfaces of both left and right side faces of the main frame, and which are provided at lower rear positions from connection axes of the control links and the central mounting parts, may be adopted.

According to the above constitution, the notched parts at the lower rear part of the driver's cab to avoid the masts are not needed, and the shape of the driver's cab can be simplified.

Further, in the vertical lift type arm device, a constitution, in which projected parts which are projected rearward from a rear end face of the main frame are provided at upper parts of the set of left and right upright members, and the lower end parts of the rear links are pivotably attached to the projected parts, may be adopted.

According to the above constitution, the large distances between the centers of rotation of the lower end parts of the rear links and the centers in the longitudinal direction of the lift cylinders can be taken. Consequently, the lifting force at the tip end parts of the lift arms when the lift arms are lowered can be made larger, and in addition, fluctuations in the lifting force at the tip end parts of the lift arms can be made smaller.

Further, in the vertical lift type arm device, a constitution, in which orientations of upper end parts of the lift cylinders are upward to the rear in a state in which the lift arms are the most lowered, may be adopted.

According to the above constitution, fluctuations in the lifting force at the tip end parts of the lift arms when the lift arms are raised can be made small.

Further, in the vertical lift arm device, a constitution, in which the rear parts of the lift arms include at least double side faces each constituted by two side plates, and at least parts of the control links are each sandwiched by the two side plates, may be adopted.

According to the above constitution, the control links are each placed between both the side plates of the lift arm, and therefore interference between the lift arms and the control links can be prevented. Further, since the lift arms can be made in substantially a straight shape, the top faces of the lift arms can be made lower when the lift arms are lowered, and visibility in the lateral direction from the driver's cab can be improved. Further, since the lift arms can be made in a straight shape without being curved, strain force caused by twisting is not exerted, and there are few stress concentrating parts, thus making it possible to enhance the strength of the lift arms.

Further, in the vertical lift type arm device, a constitution, in which the rear parts of the lift arms each include two side plates which constitute a double side face, an upper plate constituting a part of or an entire part of an upper face, and an opening opened toward a lower position, and at least a part of each of the control links is housed in the opening, may be adopted.

According to the above constitution, the control links are housed in the openings which are opened toward the lower positions of the lift arms, and interference can be prevented. As a result, the lift arms can be made in substantially straight shape, and therefore the top faces of the lift arms can be made low when the lift arms are lowered, thus making it possible to improve visibility in the lateral direction from the driver's cab. A part of, or the entire part of the top faces of the lift arms can be connected in the shape which does not interfere with the rear end parts of the rotating control links, whereby the strength of the lift arms can be also improved.

BEST MODE FOR CARRYING OUT THE INVENTION

Embodiments according to the present invention will be explained below with reference to the drawings.

Figure 1:
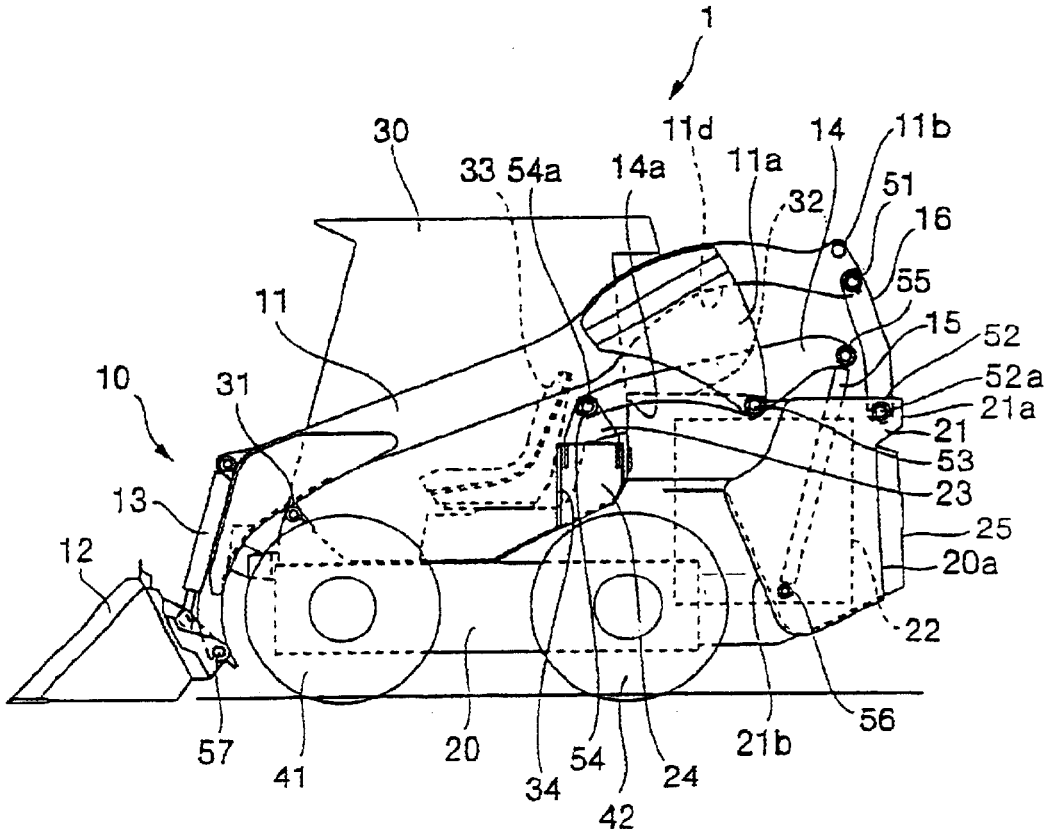
FIG. 1 is a side view of a skid-steer loader including a vertical lift type arm device according to an embodiment of the present invention.
Figure 2:
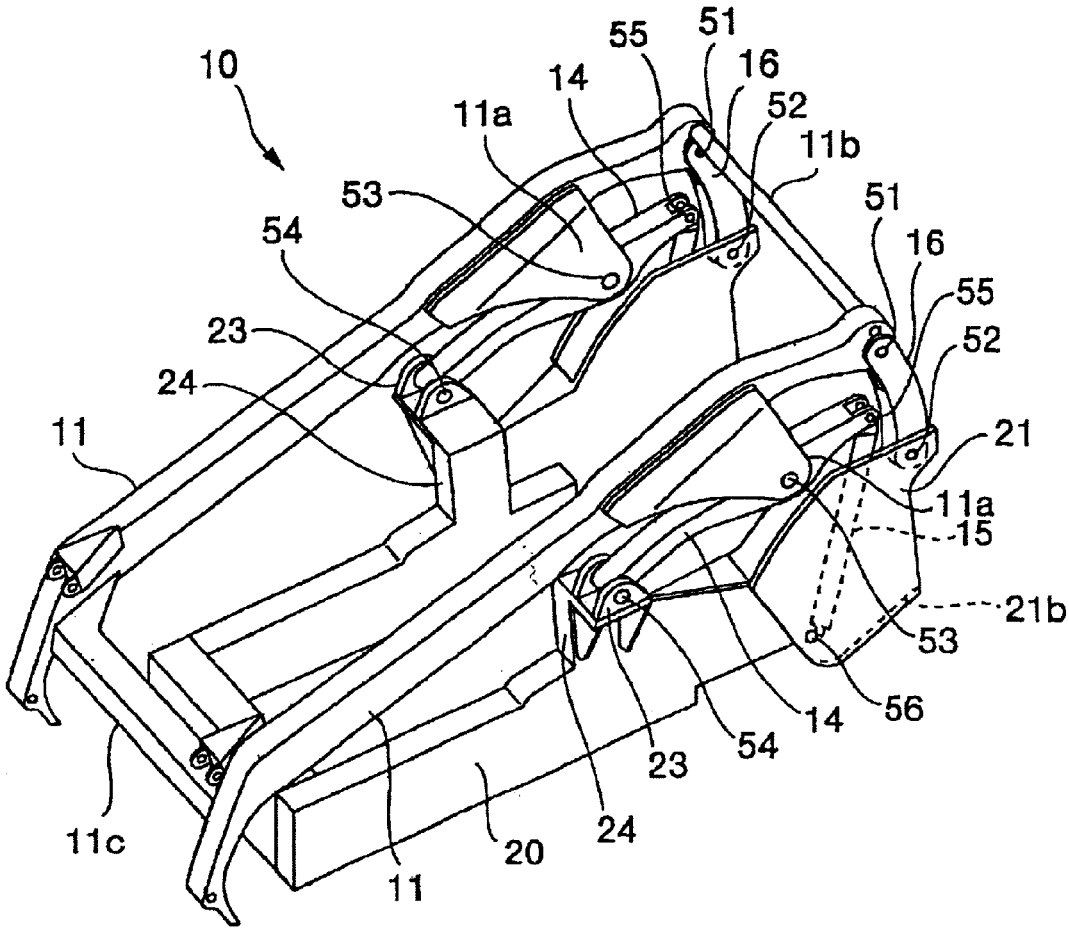
FIG. 2 is a perspective view of the vertical lift type arm device in FIG. 1.

FIG. 1 is a side view showing a vertical lift type arm device according to an embodiment of the present invention. The left side is a front of a vehicle body in FIG. 1. FIG. 2 is a perspective view of the vertical lift type arm device of this embodiment. A skid steer-loader 1 as a working vehicle has a main frame 20 which extends longitudinally, has a link device 10 at the main frame 20, has an engine 22 at a rear part of the main frame 20, and has a driver's cab 30 including a driver's seat 33 on an upper surface of the main frame 20. It has front wheels 41 at a lower front part of the main frame 20 and rear wheels 42 at a lower rear part thereof. A bucket 12, which is made capable of rising and lowering by bucket cylinders 13, is rotatably provided by being attached at front end parts of a set of left and right lift arms 11 of the link device 10 by means of pins 57.

The link device 10 has a set of left and right lift arms 11, a set of left and right rear links 16 and a set of left and right control links 14. Each of rear parts of the lift arms 11 has a curved part 11*d* that is curved upward, and a bottom side part of a mounting part 11*a* in a substantially inverted-triangle shape is provided by being fixed to a front part of the aforementioned curved part 11*d*. Vertex parts of the mounting parts 11*a* extending downward are pivotably attached to center parts in the longitudinal direction of the control links 14 having three connection holes by means of pins 53, respectively. Rear end parts of the lift arms 11 are pivotably attached at upper end parts of the rear links 16 by means of pins 51, respectively. Upright members 21 are provided at a rear part of the main frame 20, and projected parts 21*a* which are projected rearward from a rear end face 20*a* of the main frame 20 are provided at upper parts of the upright members 21. Lower end parts of the rear links 16 are pivotably attached to the projected parts 21*a* by means of pins 52, respectively.

The center parts in the longitudinal direction of the control links 14 are projected downward, and lower faces of front parts have curved parts 14*a* which are curved upward. Front end parts of the control links 14 are pivotably attached to a set of left and right central mounting parts 23 by means of pins 54, respectively. Each of connection axes 54*a* being centers of rotation of connecting parts of the front end parts of the control links 14 and the connecting parts of the central mounting parts 23 is provided at a higher position than each of connecting axes 52*a* being centers of rotation of connecting parts of the lower end parts of the rear links 16 and the main frame 20.

The left and right central mounting parts 23 are provided on upper faces of left and right masts 24 which are vertically placed on center parts in the longitudinal direction of the main frame 20 each with two plates being opposed each other. The left and right central mounting parts 23 are each projected from both left and right side faces of the main frame 20, they are provided to be off-set with both the left and right side faces of the main frame 20, and they are attached to the control links 14 with the pins 54 so as to sandwich the control links 14 each with the aforementioned two plates. Rod upper end parts that are upper end parts of a set of left and right lift cylinders 15 are pivotably attached to rear end parts of the control links 14 by means of pins 55, respectively. Cylinder lower end parts that are lower end parts of the lift cylinders 15 are pivotably attached in the vicinity of the engine 22 at the rear part of the main frame 20 by means of pins 56, respectively. Extension and contraction of the lift cylinders 15 make it possible to raise and lower tip ends of the lift arms 11 of the link device 10.

The set of the left and right lift arms 11 have both end parts of a rear cross member 11*b* fixed to rear end parts thereof, and connected thereto, respectively. Accordingly, the left and the right lift arms 11 are fixed by the rear cross member 11*b*, and therefore the lift arms 11 have high torsional rigidity and are difficult to deform when the lift arms 11 are raised and lowered. Further, the left and right lift arms 11 have both end parts of a front cross member 11*c* fixed to front parts thereof, and connected thereto, respectively. Accordingly, the left and the right lift arms 11 are fixed by the front cross member 11*c*, and therefore the lift arms 11 have high torsional rigidity and are difficult to deform even when performing an operation of scooping earth and sand by the bucket 12 which is provided at the front end parts of the lift arms 11.

The set of the left and right rear links 16 have center parts bent to project to a rear side of the vehicle body in the side view as shown in FIG. 1, and upper end parts thereof are branched, which sandwich the left and right rear end parts of the lift arms 11, respectively and are attached to them with the pins 51. The mounting parts 11*a* are each constituted by two plates, which sandwich an inner side and an outer side of the lift arm 11, and which sandwich the center part of the control link 14 at their vertex portions and attached thereto by the pin 53. The rear end parts of the set of the left and right control links 14 are branched, each of which sandwiches the rod part of the lift cylinder 15 and attached thereto by means of the pin 55. The left and right upright members 21, which are provided at the rear part of the main frame 20, are constituted by fixing plates on left and right side faces of the main frame 20 and plates, which are provided with predetermined spaces from the left and right side faces, via plates 21*b*.

The driver's cab 30 is rotatably attached to the main frame 20 at a lower front end part 31 thereof. An engine room cover 32 is rotatably attached to a rear face of the driver's cab at an upper front end part thereof. When the engine cover 32 is rotated upward to the front, an inside of an engine room can be checked. When the driver's cab 30 is rotated around the lower front end part 31 upward to the front, it is possible to check an inside of a transmission chamber not shown and the inside of the engine room. Notched parts 34 each in an inverted-L shape are provided at lower rear parts of the driver's cab 30 to avoid the masts 24. A rear cover 25 is provided at a rear surface of the main frame 20.

Figure 3:
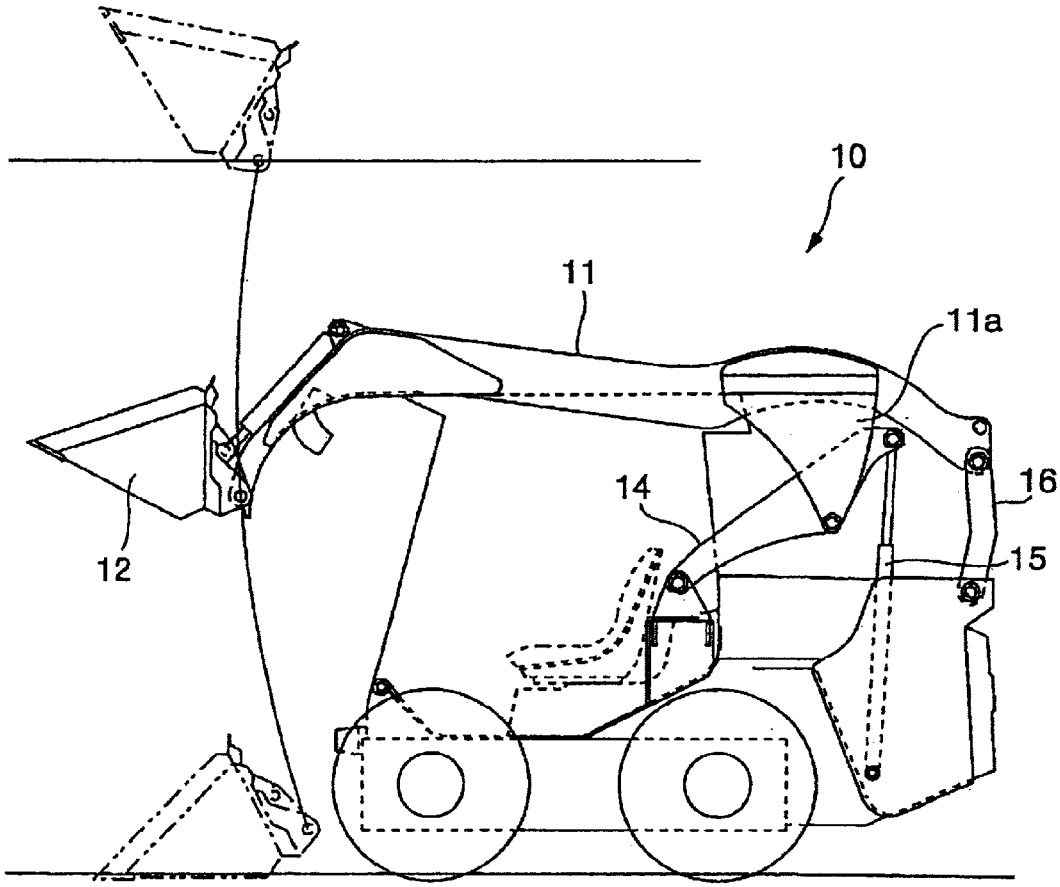
FIG. 3 is a side view showing an operation in a case in which lift cylinders of the vertical lift type arm device in FIG. 1 are extended to be as long as a half of the maximum stroke.

Next, an operation of the vertical lift type arm device of the above-described embodiment will be explained. The lift cylinders 15 are extended by a hydraulic pressure source and a control valve not shown. Then, up to an intermediate rising position in the case when the lift cylinders 15 are extended up to a half of the maximum stroke as shown in FIG. 3, the connection points with the bucket 12, which are provided at the front end parts of the lift arms 11, move froward by the control links 14 and the lift arms 11. Meanwhile, the rear links 16 are moved slightly rearward by the relationship between the control links 14 and the mounting parts 11*a*. With these movements being synthesized, the locus of the connection points with the bucket 12 which is provided at the front end parts of the lift arms 11 is moved forward of the skid-steer loader 1 along the arc in FIG. 3, from the most lowered position shown in FIG. 1. Next, when the lift cylinder 15 is extended up to the maximum stroke, the connection points with the bucket 12 at the front end parts of the lift arms 11 is moved rearward, from the intermediate rising position shown in FIG. 3 to the maximum rising position shown in FIG. 4. However, the rear links 16 are moved forward by the relationship between the control links 14 and the mounting parts 11*a*, then the lift arms 11 are moved forward by the control links 14, and as a result that these movements are synthesized, the lift arms 11 are moved forward significantly, whereby the locus of the connection points with the bucket 12 at the front end parts of the lift arms 11 is moved substantially vertically.

Figure 19:
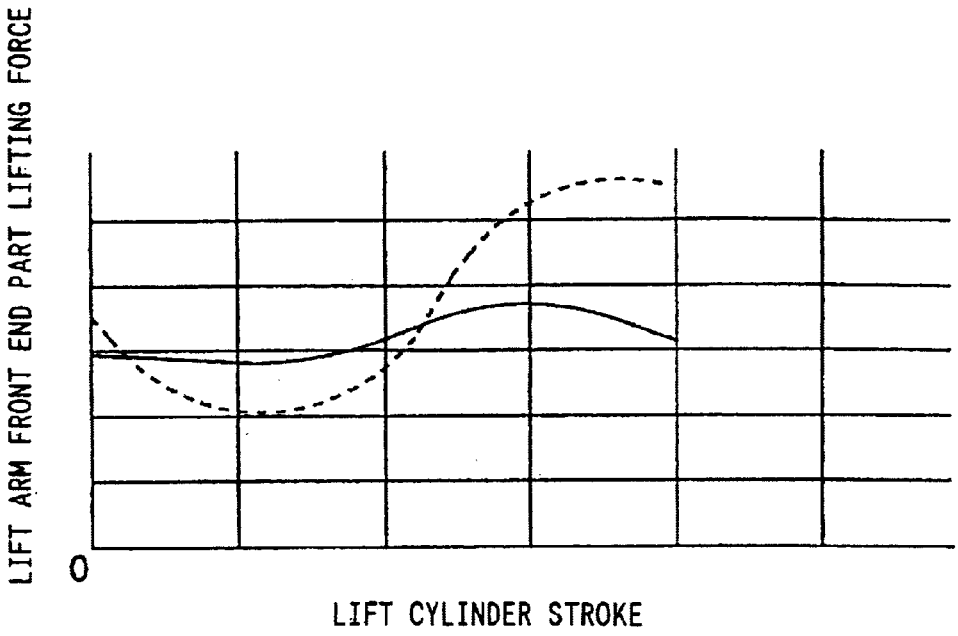
FIG. 19 is a graph showing relationships between strokes of lift cylinders and cutting edge lifting forces of buckets in the present invention and the prior art.

The lifting force of the front end parts of the lift arms 11 in this case is as shown by the solid line in FIG. 19. Accordingly, a change in the lifting force of the front end parts of the lift arms 11 while the strokes of the lift cylinders 15 change from zero to the maximum stroke is smaller as compared with the prior art disclosed in Japanese Patent Laid-open No. 6-26068. This is because the link device 10 is constituted as described above in this embodiment, while the lift cylinders 115 are directly connected to the lift arms 111 in the vertical lift type arm device disclosed in Japanese Patent Laid-open No. 6-26068. Namely, in the case of the vertical lift type arm device of this embodiment, the upper end parts of the lift cylinders 15 are connected to the rear end parts of the control links 14, and the lift arms 11 are connected to the center parts of the control links 14. Consequently, when the lift cylinders 15 are extended, the lift cylinders 15 press the rear end parts of the control links 14, and the center parts of the control links 14 press the lift arms 11, thus making it possible to enlarge the lifting force to raise the lift arms 11, and reduce a fluctuation in moment to rotate the lift arms 11. Accordingly, a fluctuation in the lifting force of the front end parts of the lift arms 11 in the case when the lift arms 11 are raised is small.

Figure 4:
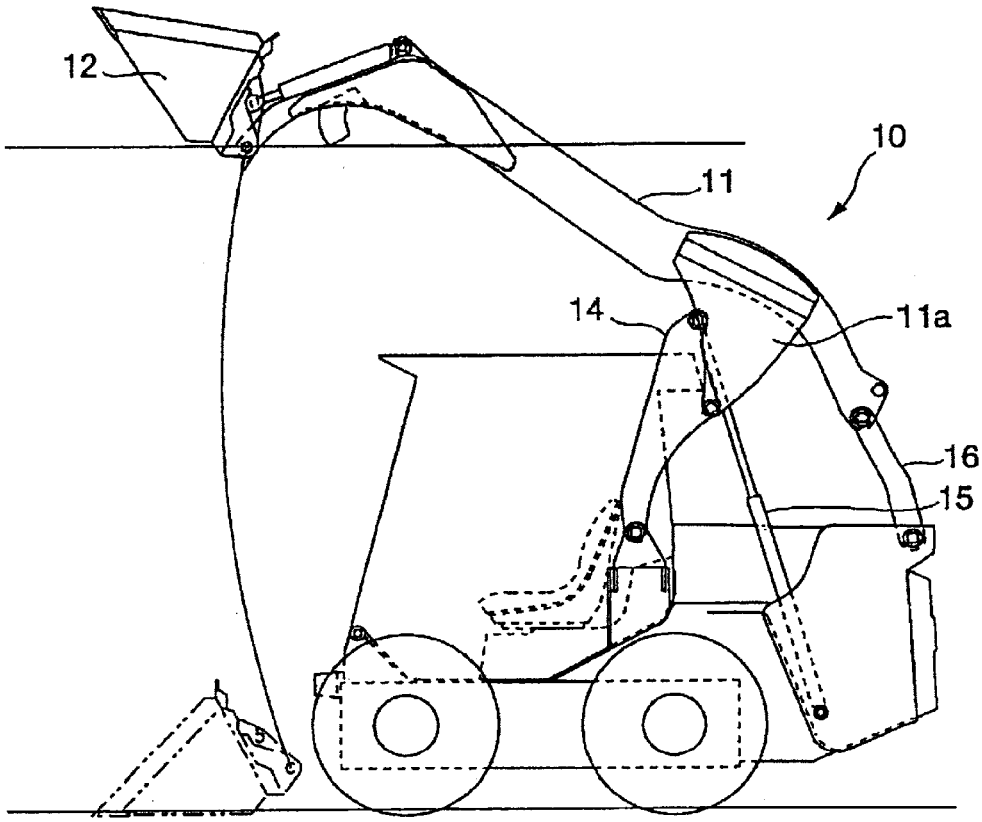
FIG. 4 is a side view showing an operation in a case in which the lift cylinders of the vertical lift type arm device in FIG. 1 are extended to be as long as the maximum stroke.

As shown in FIG. 3 and FIG. 4, in the case of the vertical lift type arm device of this embodiment, the mounting parts 11*a* of the lift arms 11 and the control links 14 are provided at rear positions from the driver's seat 33 in the driver's cab 30. Consequently, even if the lift arms 11 are raised, there are no links that obstruct the view of the operator as the mounting parts 111*a* and the rods 114 of the vertical lift type arm device, which is described in Japanese Patent Laid-open No. 6-26068 of the prior art, in the lateral direction of the driver's cab 30. There are no lift cylinders 215 that obstruct the view of the operator in the lateral direction of the driver's cab 230 when the lift arms 211 are raised, as described in the U.S. Pat. No. 5,609,464, which is another prior art. Accordingly, the visibility in the lateral direction from the driver's cab 30 in this embodiment is good.

In the case of the vertical lift type arm device of this embodiment, the lift cylinders 15 press the rear end parts of the control links 14, and the lift arms 11 are connected to the center parts of the control links 14, therefore making it possible to enlarge the lift force as described above. Namely, in the U.S. Pat. No. 5,609,464 of the prior art, the rod front end parts that are the front end parts of the lift cylinders 215 are attached to the central front parts in the longitudinal direction of the lift arms 211 to make the lifting force larger, and therefore the lift cylinders 215 with long strokes are needed. On the other hand, in the case of the vertical lift type arm device of this embodiment, it is suitable that the length of the lift cylinders 15 is short. Accordingly, the weight of the vehicle can be reduced.

In the Japanese Patent Laid-open No. 6-26068 of the prior art, the lift cylinders 115 and the mounting parts 111*a* of the lift arms 111 are located at the side faces of the engine 122 in the state in which the lift arms 111 are lowered. In the one disclosed in the U.S. Pat. No. 5,609,464, the lift cylinders 215 are located at the side faces of the engine 222 in the state in which the lift arms 211 are lowered. Consequently, in any of these prior arts, they become obstacles in performing maintenance of the side faces of the engine, thus causing a problem in maintainability. On the other hand, in the case of the vertical lift type arm device of this embodiment, the connection axes 54*a* being the centers of rotation of the front end parts of the control links 14 are provided at the same height as the connection axes 52*a* being the centers of rotation of the lower end parts of the rear links 16, or at a higher position than the connection axes 52*a*. Consequently, the control links 14 are located at a higher position than the engine 22 so that they do not block the side faces of the engine 22. Accordingly, when the engine room cover 32 is rotated upward and opened, the control links 14 do not become obstacles and maintenance of the side faces of the engine 22 can be facilitated. Further, since the lower faces of the front parts of the control links 14 are curved upward, a space in which a hand is put from the side face of the engine 22 is secured by the curved part 14*a* formation part. As a result, the maintenance of the side faces of the engine 22 is facilitated. Further, since the lift cylinders 15 are located behind the engine room cover 32, the lift cylinders 15 do not cover the side faces of the engine 22, and therefore maintenance of the side faces of the engine 22 is facilitated.

Further, the rear parts of the set of the lift arms 11 have the curved parts 11*d* which are curved upward, and thereby interference between the rear ends of the control links 14 and the lift arms 11 can be avoided when the lift arms 11 are raised and lowered. As a result, the left and the right lift arms 11 and the control links 14 can be placed within predetermined widths seen from the top face. Consequently, since the link device 10 lies off the vehicle body in the lateral direction by only a small amount, a twisting force is not exerted on the lift arms 11, and therefore the link device 10 is never twisted.

Further, the set of the left and the right rear links 16 are bent at the center parts to be projected rearward from the vehicle body in the side view as shown in FIG. 1. Thereby, interference between the rear ends of the control links 14 and the rear links 16 can be avoided when the lift arms 11 are raised and lowered. As a result, the lift arms 11 and the control links 14 can be placed within predetermined widths seen from the top face; and since the link device 10 lies off the vehicle body in the lateral direction by only a small amount, and a twisting force is not exerted on the lift arms 11, the link device 10 is not twisted. Furthermore, the connection parts of the rear end parts of the control links 14 and the upper end parts of the lift cylinders 15 can be located in a further rearward position, and therefore the lifting force when the lift arms 11 are raised can be increased.

Figure 5:
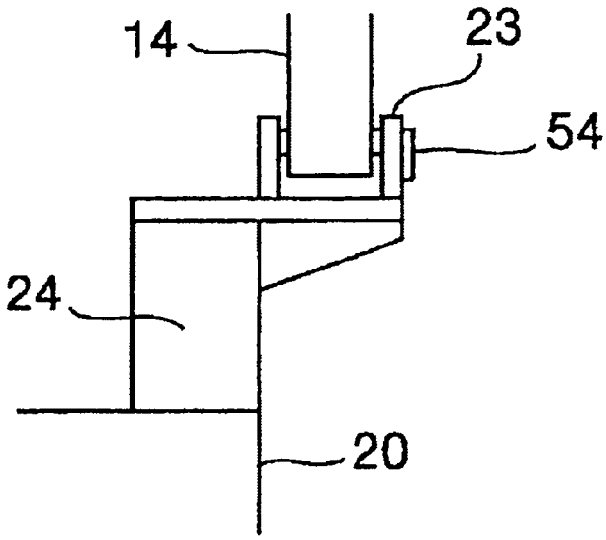
FIG. 5 is a view showing placement of a mast of the vertical lift type arm device in FIG. 1.
Figure 6:
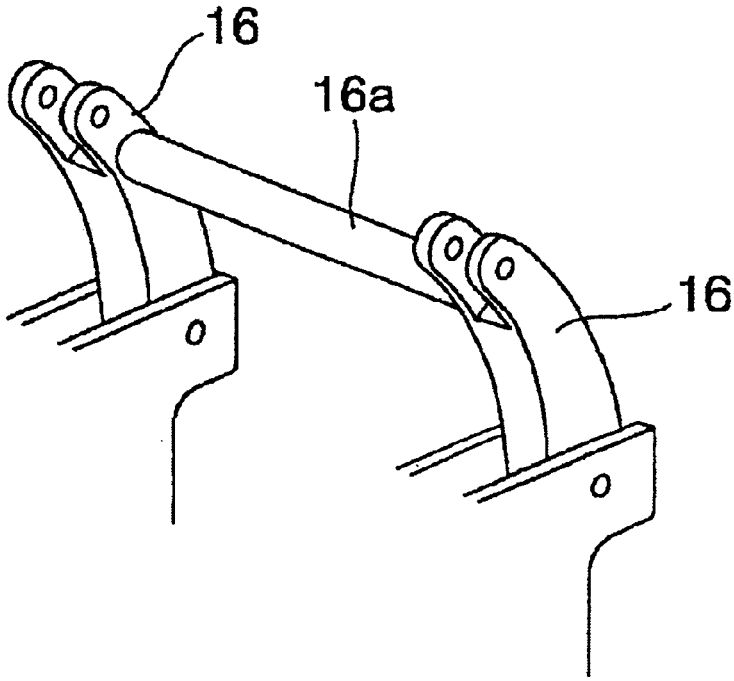
FIG. 6 is a perspective view showing another embodiment of rear links of the vertical lift type arm device according to the present invention.

As shown in FIG. 5, the left and the right masts 24, which are vertically provided at the center parts in the longitudinal direction of the main frame 20, have the upper parts formed in the inverted-L shape and projected from both the left and the right side faces of the main frame 20, respectively. The left and the right central mounting parts 23 are provided on the top surfaces of the masts 24 each with two plates opposing each other, and attached to the control links 14 with the pins 54 so as to sandwich the control links 14 each with the aforementioned two plates. As a result, the left and the right lift arms 11, the control links 14 and the rear links 16 can be placed within predetermined widths seen from the top surface, and therefore the link device 10 lies off the vehicle body in the lateral direction by only a small amount, thus making it possible to place the left and the right constitution parts of the link device 10 in substantially one plane. Consequently, the twisting force is not exerted on the lift arms 11, and therefore the link device 10 is never twisted.

Concerning the rear links 16, both ends of a cross member 16*a* may be fixed to the left and the right rear links 16 and connected. Thereby, the left and the right rear links 16 are fixed by the cross member 16*a*, and therefore the rigidity of the link device 10 is enhanced, thus making the link device 10 difficult to twist.

Figure 7:
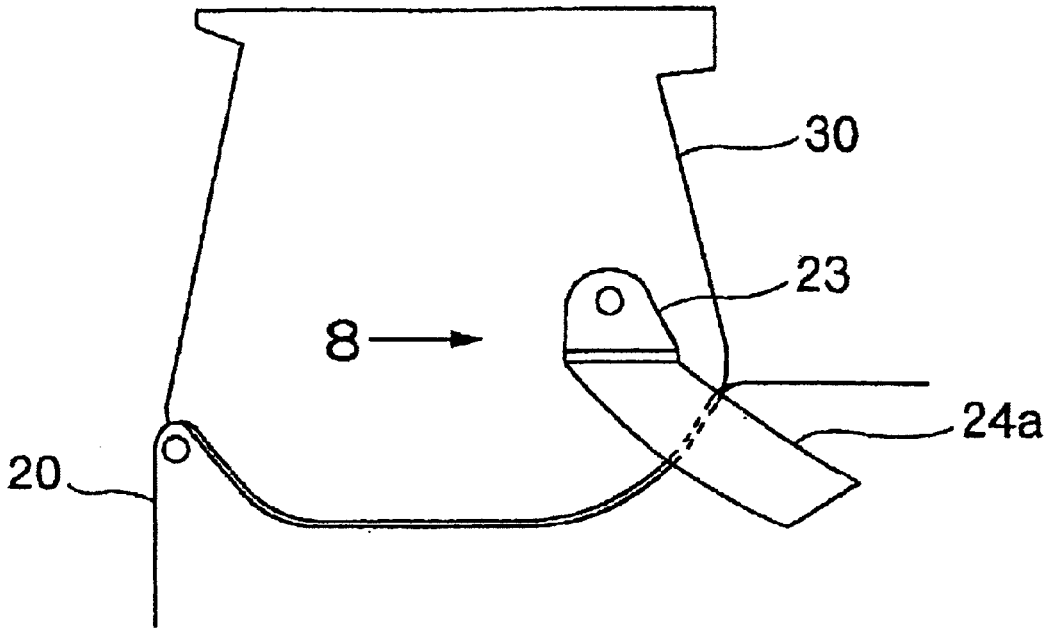
FIG. 7 is a side view showing another embodiment of a mast of the vertical lift type arm device according to the present invention.
Figure 8:
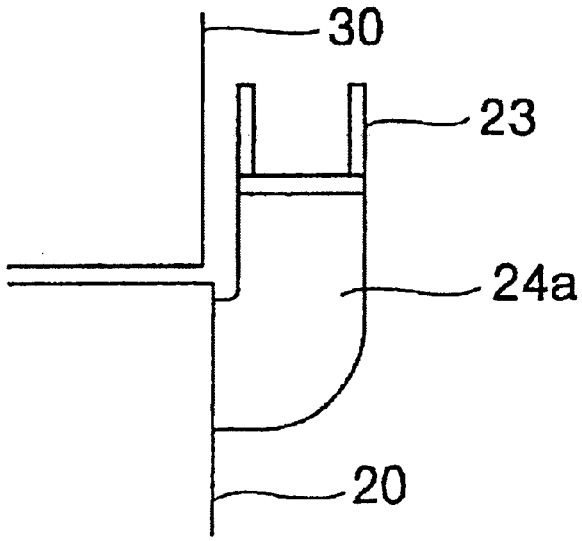
FIG. 8 is a view seen in a direction of the arrow 8 in FIG. 7.

The left and the right masts 24 are not limited to that in FIG. 5, and they may be attached in such a manner that left and right masts 24*a* are vertically provided at the side faces of the main frame 20 in the shape of substantially the letter of J as shown in FIG. 7 and FIG. 8. The lower part of the mast 24*a* is extended downward to the rear as shown in FIG. 7. The central mounting part 23 is provided at a top face of the mast 24*a*. This makes it unnecessary to provide the notched parts 34 in the inverted-L shape at the lower rear parts of the driver's cab 30 as described above, and the shape of the driver's cab 30 can be simplified.

Further, as explained in FIG. 1, the lower end parts of the rear links 16 are pivotably attached to the projected parts 21*a* of the upright members 21, which are projected rearward from the rear end face 20*a* of the main frame 20 with the pins 52. As a result, the distance between the center of rotation of the lower end part of the rear link 16 and the center in the longitudinal direction of the lift cylinder 15 can be taken to be long, and therefore when the bucket 12 is lowered to perform an excavating operation, an edge lifting force during dynamic lift off can be made large, and fluctuations in the edge lifting force can be reduced. Namely, when the lift arms 11 are raised, fluctuations in the lifting force of the front end parts of the lift arms 11 are small.

Figure 15:
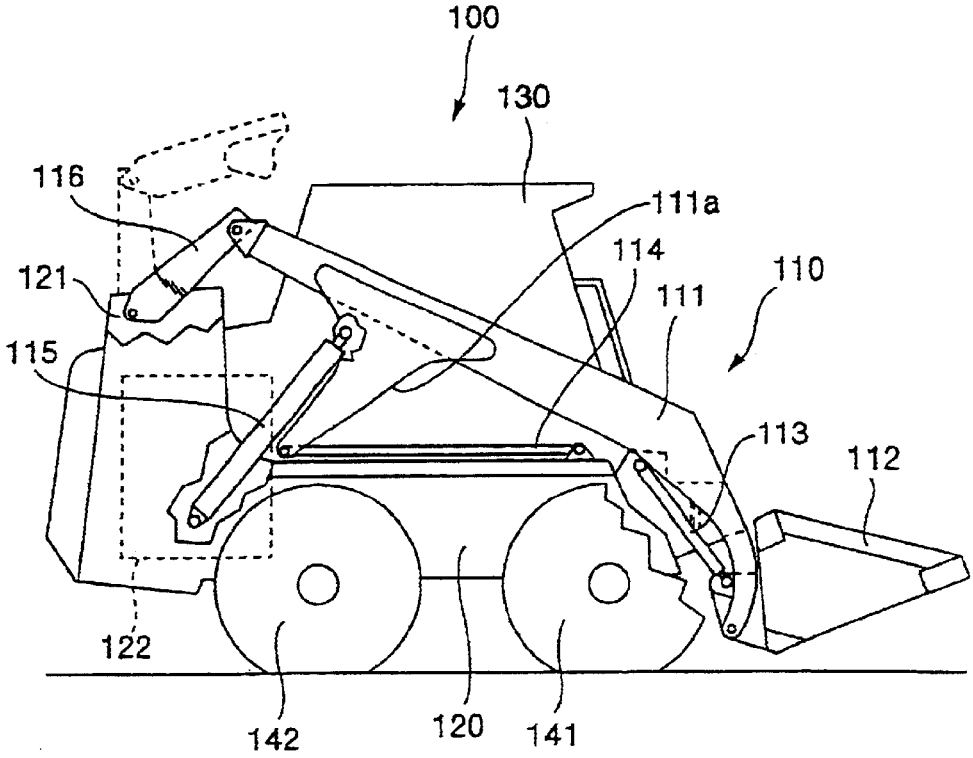
FIG. 15 PRIOR ART
FIG. 15 is a side view of a skid-steer loader including a conventional vertical lift type arm device.
Figure 16:
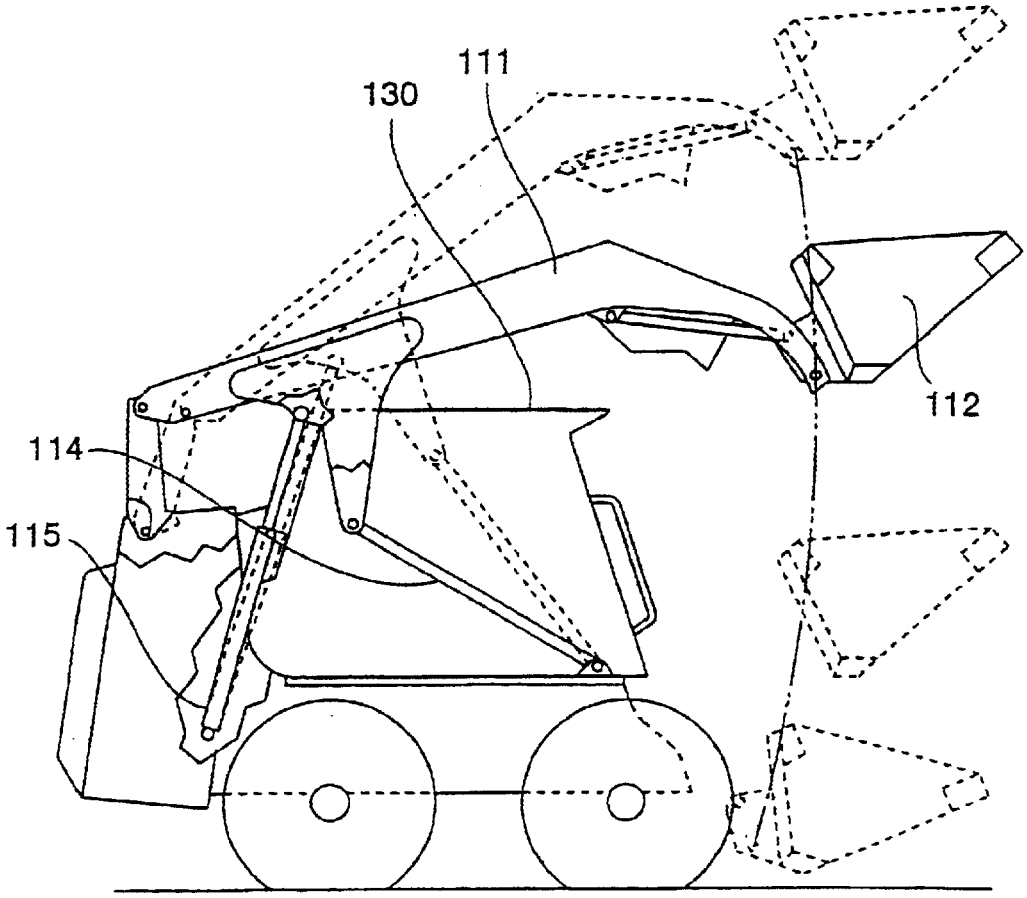
PRIOR ART FIG. 16
FIG. 16 is a side view showing an operation of the vertical lift type arm device in FIG. 15.
Figure 17:
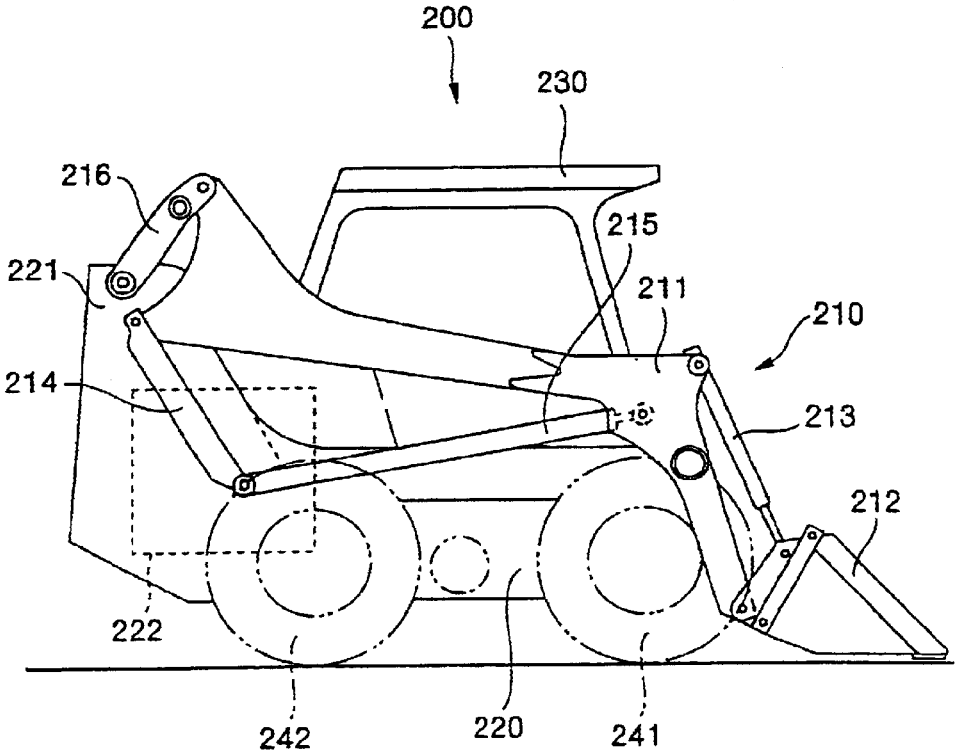
FIG. 17 PRIOR ART
FIG. 17 is a side view of a skid-steer loader including another conventional vertical lift type arm device.
Figure 18:
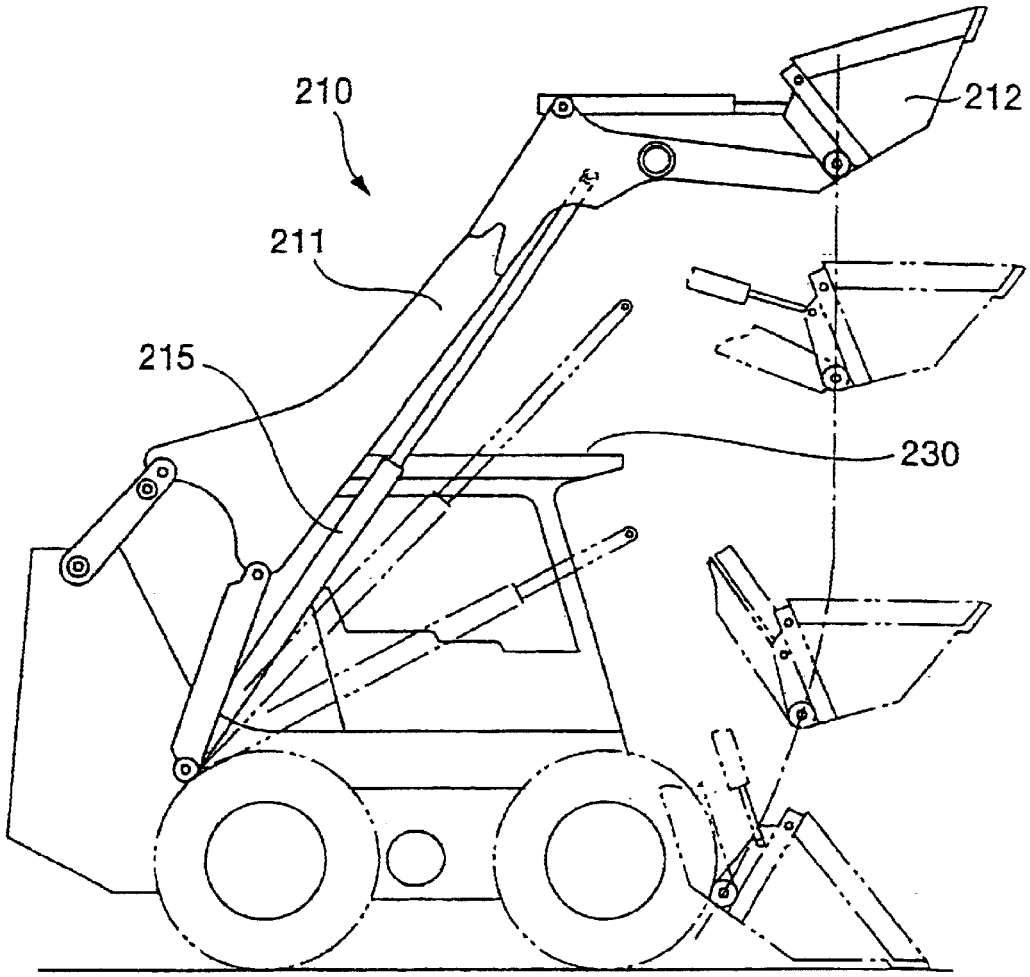
FIG. 18 PRIOR ART
FIG. 18 is a side view showing an operation of the vertical lift type arm device in FIG. 17.

According to Japanese Patent Laid-open No. 6-26068 and the U.S. Pat. No. 5,609,464 of the prior arts, the lift cylinders 115 and 215 face upward to the front as shown in FIG. 15 and FIG. 18. On the other hand, the vertical lift type arm device of the present invention is made the device in which the lower end parts of the lift cylinders 15 (the lower end parts at the cylinder side in this embodiment) are attached to the lower rear parts of the main frame 20, and the orientations of the lift cylinders 15 are upward to the rear (the tip ends of the rods face upward to the rear in this embodiment) in the state in which the bucket 12 is the most lowered. Thus, fluctuations in the edge lifting force of the bucket 12 can be reduced as described above. Namely, when the lift arms 11 are raised, fluctuations in the lifting force of the front end parts of the lift arms 11 are small.

Figure 9:
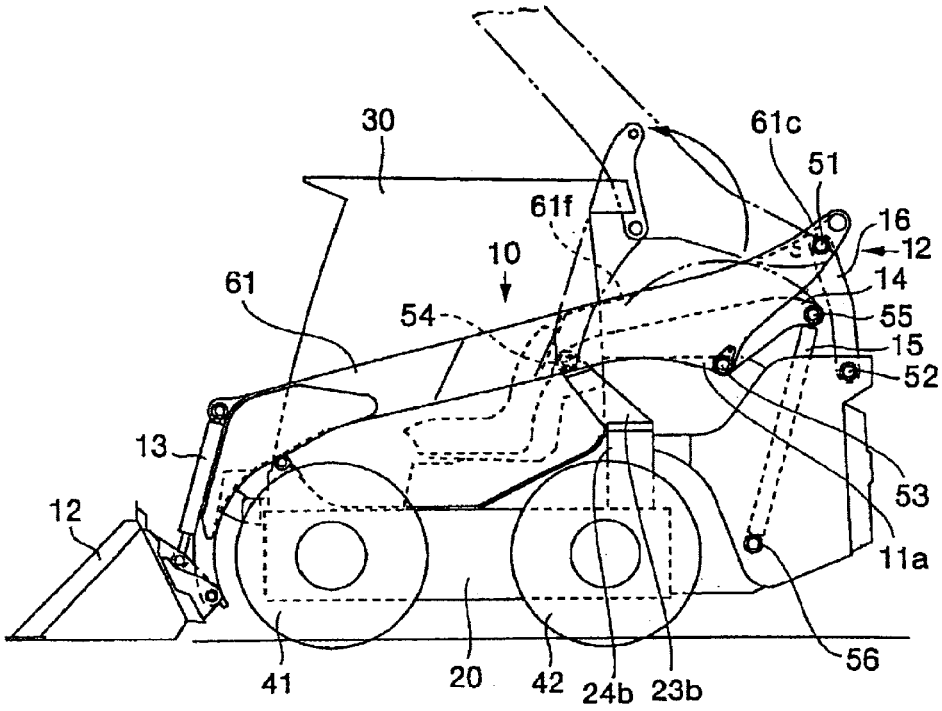
FIG. 9 is a side view of a skid-steer loader including a vertical lift type arm device of another embodiment of the present invention.

In the above-described embodiment, the rear parts of the lift arms 11 are in the shape curved upward, but as shown in FIG. 9, lift arms 61 with the structure capable of housing parts of the control links 14 may be adopted as shown in FIG. 9.

Figure 10:
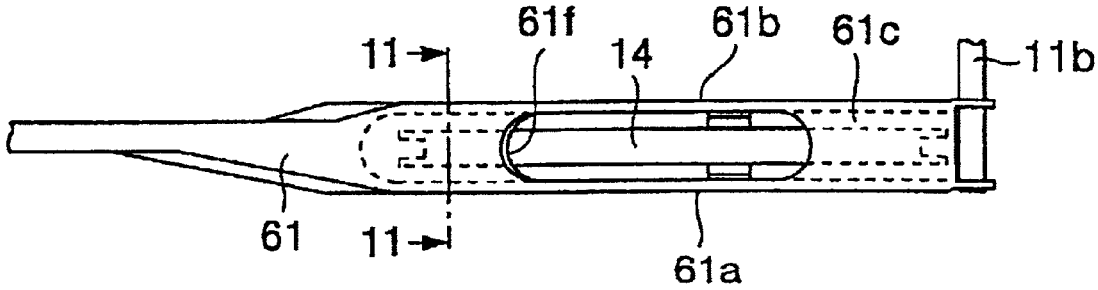
FIG. 10 is a view seen in a direction of the arrow 10 in FIG. 9.
Figure 11:
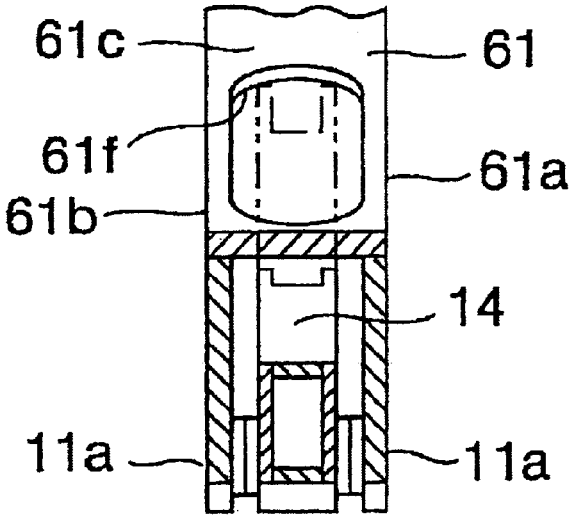
FIG. 11 is a sectional view taken along the line 11—11 in FIG. 10.
Figure 12:
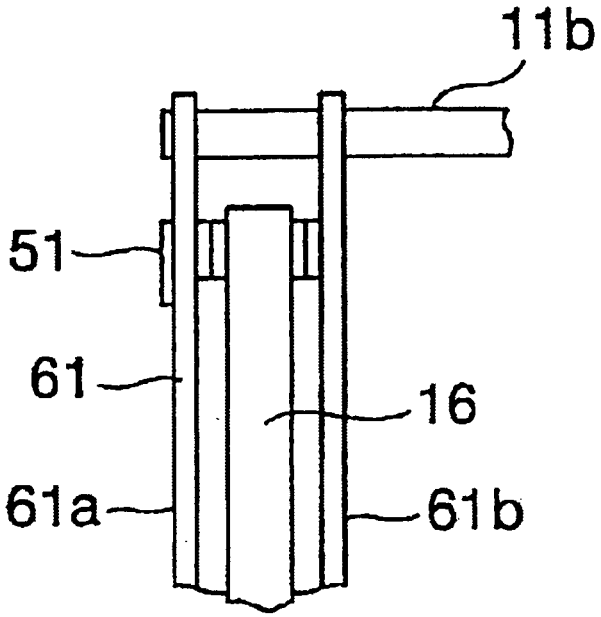
FIG. 12 is a view seen in a direction of the arrow 12 in FIG. 9.
Figure 13:
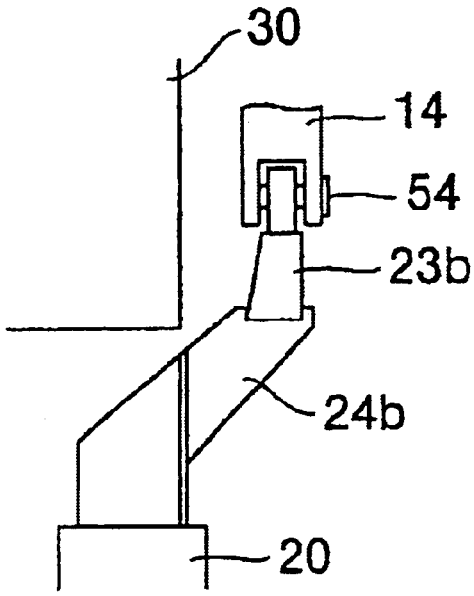
FIG. 13 is a view showing placement of a mast of the vertical lift type arm device in FIG. 9.

Namely, the lift arms 61 except longitudinal both end parts are straight in the side view, and top faces thereof are planes facing the connection pins 51 which connect the rear links 16 and the lift arms 61. As shown in FIG. 10 and FIG. 11, the rear part of the lift arm 61 is larger in width than the front part, and both left and right side plates 61*a* and 61*b* and an upper plate 61*c* of the lift arm 61 are constituted to be a shape opened toward a lower position by a method such as welding. Further, the rear part of the lift arm 61 includes the mounting parts 11*a* extending downward from both the left and right side plates 61*a* and 61*b*, and a hole 61*f* is provided at the upper plate 61*c*. A rear end part of the lift arm 61 also has a continuous shape opened toward a lower position, and as shown in FIG. 12, the upper end part of the rear link 16 is attached to the both left and right side plates 61*a* and 61*b* of the lift arm 61 by the pin 51 in such a manner as it is sandwiched by the both left and right side plates 61*a* and 61*b*. As shown in FIG. 13, the front end part of the control link 14 is branched, which sandwiches the tip end part of the central mounting part 23*b* vertically provided at the upper face of the mast 24*b* and attached to the tip end part with the pin 54. The masts 24*b* are provided at both the left and right side faces of the main frame 20 to be projected sideward from the main frame 20 behind the driver's cab 30 as shown in FIG. 9 and FIG. 13. The central mounting part 23*b* is in a shape extending downward to the rear from the attaching part with the pin 54, which is at the front end side, and is attached to the top face of the mast 24*b*. The front end part of the control link 14 is explained as branched, but the front end part of the central mounting part 23*b* may be branched instead as in FIG. 5 if only there is no interference with the lift arm 61. Further, instead of the central mounting parts 23*b* and the masts 24*b*, the central mounting parts 23 and the masts 24*a*, which are explained in FIG. 7 and FIG. 8, may be used.

As constituted as above, the control link 14 is made rotatable in such a manner as the control link 14 including both the longitudinal end parts is sandwiched between both the left and right side plates 61*a* and 61*b* of the lift arm 61. The rear end part of the control link 14 is projected upward from the top face of the lift arm 61 by the rotation around the pin 53, but the upper plate 61*c* is provided with the hole 61*f*, and therefore the control link 14 is rotatable without interfering with the lift arm 61. Consequently, it is not necessary to provide the curved part 11*d* for preventing interference with the control link 14 as in the lift arm 11 in FIG. 1, and the top face of the lift arm 61 except both the end parts can be lowered to be as low as the plane facing the connection pin 51. Thus, visibility in the left and right direction in the state in which the lift arms 61 are lowered, visibility especially in a diagonally rear direction, can be improved. Further, since the lift arm 61 does not have the curved part 11*d* as shown in FIG. 1, a strained force is not exerted by twisting, thus making it possible to provide a structure excellent in strength with less stress concentrating parts.

The rear part of the lift arm 61 may have the structure with only both the left and right side plates 61*a* and 61*b* without providing the upper plate 61*c*, but the strength of the lift arm 61 can be increased by providing the upper plate 61*c* connecting the upper end parts of both the left and right side plates 61*a* and 61*b* while avoiding interference with the control link 14 (see FIG. 10). In the rear part of the lift arm 61, both the left and right side plates 61*a* and 61*b*, and the upper plate 61*c* may not be constructed by welding, but they may be integrally constructed by molding by casting or forming by press working.

Figure 14:
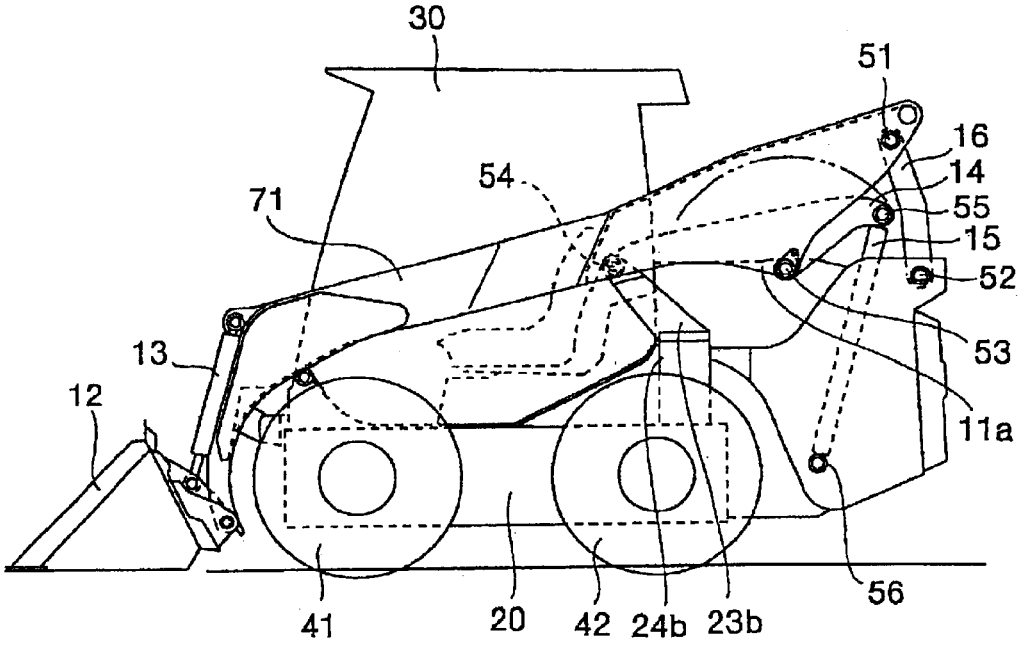
FIG. 14 is a side view of a skid-steer loader including a vertical lift type arm device of still another embodiment of the present invention.

Further, instead of including the hole 61*f* in the upper plate 61*c* of the lift arm 61 as in FIG. 9, the top face of a lift arm 71 is made high to be a little higher than the locus of the rear end of the control link 14, and the hole (corresponding to the hole 61*f* in FIG. 9) may be abolished, as shown in FIG. 14. With this constitution, the same operation can be also obtained. Further, with the structure in which the upper face of the lift arm 71 is blocked, the strength of the lift arm 71 can be further enhanced. It goes without saying that the rear part of the lift arm 71 in FIG. 14 may be integrally constructed by molding by casting or forming by pressing working.

INDUSTRIAL AVAILABILITY

The present invention is useful as a vertical lift type arm device with excellent maintainability of side faces of an engine, with excellent visibility in a lateral direction from a driver's cab, and with small fluctuations in lifting force of front end parts of lift arms.

What is claimed is:

1. A vertical lift type arm device in which rear end parts of a set of left and right lift arms are pivotably attached to a set of left and right upright members, which are vertically provided at a rear part of a main frame of a working vehicle, via a set of left and right rear links, comprising:

a set of left and right control links each having three connection shaft holes;

a set of left and right central mounting parts which are provided at a center part of said main frame; and a set of left and right mounting parts which are provided at rear parts of said lift arms and extend downward, wherein front end parts of said control links and said central mounting parts are pivotably attached to each other;

wherein center parts of said control links and lower end parts of said mounting parts are pivotably attached to each other; and wherein connection axes of said control links and said central mounting parts are provided at a same height as or at a higher position than connection axes of lower end parts of said rear links and said main frame.

2. A vertical lift type arm device in which rear end parts of a set of left and right lift arms are pivotably attached to a set of left and right upright members, which are vertically provided at a rear part of a main frame of a working vehicle, via a set of left and right rear links, comprising:

a set of left and right control links each having three connection shaft holes;

a set of left and right central mounting parts which are provided at a center part of said main frame;

a set of left and right mounting parts which are provided at rear parts of said lift arms and extend downward; and a set of left and right lift cylinders which raise and lower said lift arms, wherein front end parts of said control links and said central mounting parts are pivotably attached to each other;

wherein center parts of said control links and lower end parts of said mounting parts are pivotably attached to each other;

wherein connection axes of said control links and said central mounting parts are provided at a same height as or at a higher position than connection axes of lower end parts of said rear links and said main frame;

wherein rear end parts of said control links are pivotably attached to upper end parts of said lift cylinders; and wherein lower end parts of said lift cylinders are pivotably attached to lower rear parts of said main frame.

3. The vertical lift type arm device according to claim 1 or claim 2, wherein undersurfaces of rear parts of said lift arms are curved upward.

4. The vertical lift type arm device according to claim 1 or claim 2, wherein undersurfaces of front parts of said control links are curved upward.

5. The vertical lift type arm device according to claim 1 or claim 2, wherein said central mounting parts are provided by being off-set outside both left and right side faces of said main frame.

6. The vertical lift type arm device according to claim 1 or claim 2, further comprising:

a rear cross member which fixes said set of left and right lift arms.

7. The vertical lift type arm device according to claim 1 or claim 2, further comprising:

a cross member which fixes said set of left and right rear links.

8. The vertical lift type arm device according to claim 1 or claim 2, further comprising:

a set of left and right masts, which are attached between the center part of said main frame and said set of left and right central mounting parts, with upper parts thereof supporting said central mounting parts, and with lower parts thereof extending downward to the rear and being attached to outer surfaces of both left and right side faces of said main frame.

9. The vertical lift type arm device according to claim 1 or claim 2, wherein said central mounting parts have lower parts thereof each formed in a shape extending downward to the rear, said vertical lift type arm device, further comprising a set of left and right masts, which are attached between the center part of said main frame and said set of left and right central mounting parts extending downward to the rear, with upper parts thereof supporting said central mounting parts, and with lower parts thereof being attached to outer surfaces of both left and right side faces of said main frame, and which are provided at lower rear positions from connection axes of said control links and said central mounting parts.

10. The vertical lift type arm device according to claim 1 or claim 2, wherein projected parts, which are projected rearward from a rear end face of said main frame, are provided at upper parts of said set of left and right upright members; and wherein the lower end parts of said rear links are pivotably attached to said projected parts.

11. The vertical lift type arm device according to claim 2, wherein orientations of upper end parts of said lift cylinders are upward to the rear in a state in which said lift arms are the most lowered.

12. The vertical lift arm device according to claim 1 or claim 2, wherein the rear parts of said lift arms include at least double side faces each constituted by two side plates; and wherein at least parts of said control links are each sandwiched by said two side plates.

13. The vertical lift type arm device according to claim 1 or claim 2, wherein the rear parts of said lift arms each include two side plates which constitute a double side face, an upper plate constituting a part of or an entire part of an upper face, and an opening opened toward a lower position; and wherein at least a part of each of said control links is housed in said opening.

* * * * *